US011022009B2

(12) United States Patent
Qu et al.

(10) Patent No.: US 11,022,009 B2
(45) Date of Patent: Jun. 1, 2021

(54) HYDRAULIC LASH ADJUSTER

(71) Applicant: Caterpillar Inc., Deerfield, IL (US)

(72) Inventors: Rong Qu, Dunlap, IL (US); Charles F. Coffey, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 5 days.

(21) Appl. No.: 16/251,773

(22) Filed: Jan. 18, 2019

(65) Prior Publication Data

US 2020/0232350 A1 Jul. 23, 2020

(51) Int. Cl.
*F01L 1/24* (2006.01)
*F01L 1/18* (2006.01)

(52) U.S. Cl.
CPC ..... *F01L 1/2422* (2013.01); *F01L 1/2405* (2013.01); *F01L 1/185* (2013.01); *F01L 2001/2444* (2013.01)

(58) Field of Classification Search
CPC ... F01L 1/185; F01L 2305/00; F01L 13/0005; F01L 1/267; F01L 2013/001; F01L 1/24; F01L 1/146; F01L 2810/02; F01L 1/245; F01L 1/2422; F01L 1/2405; F02D 41/0087
USPC ..... 123/90.55, 90.52, 90.43, 90.46, 90.12
See application file for complete search history.

(56) References Cited

U.S. PATENT DOCUMENTS 2,676,579 A * 4/1954 Gerner ..... F01L 1/2422 123/90.57
2,688,317 A * 9/1954 Voorhies ..... F01L 1/2422 123/90.55
2,721,543 A * 10/1955 Johnson ..... F01L 1/146 123/90.59
3,418,983 A * 12/1968 Sossna ..... F01L 1/146 123/90.63
3,897,761 A 8/1975 Fleischer
4,050,435 A * 9/1977 Fuller, Jr. ..... F01L 13/0005 123/198 F
4,083,334 A * 4/1978 Roncon ..... F01L 1/245 123/90.35
4,169,449 A * 10/1979 Brock, Jr. ..... F02D 13/06 123/198 F
4,763,617 A 8/1988 Honda et al.
4,917,059 A 4/1990 Umeda
7,464,678 B2 12/2008 Rozario et al.
8,695,551 B2 * 4/2014 Langewisch ..... F01L 1/2422 123/90.12
9,051,854 B1 * 6/2015 Cyborski ..... F01L 1/2422
9,091,186 B2 7/2015 Yamamoto et al.
9,157,338 B2 10/2015 Nunami et al.
9,739,181 B2 8/2017 Ozawa
9,938,862 B2 4/2018 Chandler et al.
(Continued)

FOREIGN PATENT DOCUMENTS

EP 2538043 8/2016
GB 2354287 3/2001

*Primary Examiner* — Patrick Hamo
*Assistant Examiner* — Wesley G Harris
(74) *Attorney, Agent, or Firm* — Bookoff McAndrews

(57) ABSTRACT

A hydraulic lash adjuster includes a longitudinally extending pushrod having a proximal end and a distal end, and a cavity located at the distal end and a piston received in the cavity. The piston includes an internal reservoir and a fluid pathway to the internal reservoir. The fluid pathway includes a longitudinal passage and a radial passage.

20 Claims, 3 Drawing Sheets

(56) References Cited

U.S. PATENT DOCUMENTS

| | | | |
|---|---|---|---|
| 2016/0215657 | A1 | 7/2016 | Cyborski |
| 2016/0273415 | A1 | 9/2016 | Kizhakkethara |

* cited by examiner

HYDRAULIC LASH ADJUSTER

TECHNICAL FIELD

The present disclosure relates generally to components of an internal combustion engine, and more particularly, to a hydraulic lash adjuster.

BACKGROUND

Hydraulic lash adjusters are employed in internal combustion engines to reduce clearance between engine components. This clearance, also called lash, can occur between components of a valve train, for example, resulting in the inability of an intake or exhaust valve to open and close fully. Lash can result from the expansion of engine components due to manufacturing tolerances, imperfections, wear, and thermal expansion. A hydraulic lash adjuster located between valve train components may eliminate lash by utilizing a high pressure volume located under a piston. This high pressure volume includes an incompressible fluid, such as oil, that enters via a valve. The volume of fluid maintains the length of the lash adjuster, thereby reducing or eliminating lash.

The use of hydraulic fluid allows hydraulic lash adjusters to operate with reduced need for adjustments, in contrast to solid valve lifters, even as engine components age and experience increased wear. However, hydraulic lash adjusters, which employ incompressible fluid, can produce unsatisfactory performance when air is introduced. Air bubbles that enter the high pressure region are especially problematic as they can allow the lash adjuster to compress, brining the lash adjuster out of contact with a component of the valve train. Compression in the lash adjuster can introduce valve lift loss which can result in deficient engine performance and even introduce the possibility of failure.

An exemplary valve lash adjuster is disclosed in U.S. Pat. No. 4,917,059 ("the '059 patent") to Umeda. The '059 patent discloses a hydraulic lash adjuster that includes an elongated generally cylindrical body having an exterior annular oil groove in a side wall thereof. The annular oil groove receives engine oil from an oil gallery connected to the pressure side of an engine oil lubricating system and communicating with the lifter gallery bore. The cylindrical body also includes a central cylindrical bore therein having an open end. A first oil inlet passage extends through the side wall of the body into the bore to allow for flow of oil from the annular oil groove into the bore.

While the valve lash adjuster described in the '059 patent may operate adequately under some conditions, there may be other conditions where the lash adjuster does not respond as desired. The disclosed hydraulic lash adjuster may solve one or more of the problems set forth above and/or other problems in the art. The scope of the current disclosure, however, is defined by the attached claims, and not by the ability to solve any specific problem.

SUMMARY

In one aspect, a hydraulic lash adjuster may include a longitudinally extending pushrod having a proximal end and a distal end, and a cavity located at the distal end and a piston received in the cavity. The piston may include an internal reservoir and a fluid pathway to the internal reservoir. The fluid pathway may include a longitudinal passage and a radial passage.

In another aspect, a hydraulic lash adjuster may include a longitudinally extending pushrod having a proximal end and a distal end, and a cavity located at the distal end and a piston received in the cavity. The piston may include an internal reservoir and a fluid pathway to the internal reservoir. The fluid pathway may include a longitudinal passage, a radial passage, and a circumferential recess formed in an outer surface of the piston.

In yet another aspect, a hydraulic lash adjuster may include a longitudinally extending pushrod having a proximal end and a distal end, and a cavity located at the distal end, and a piston received in the cavity, the piston including a fluid pathway having at least three turns.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion such that a process, method, article, or apparatus that comprises a list of elements does not include only those elements, but may include other elements not expressly listed or inherent to such a process, method, article, or apparatus. Moreover, in this disclosure, relative terms, such as, for example, "about," substantially," and "approximately" are used to indicate a possible variation of ±10% in the stated value.

Figure 1:
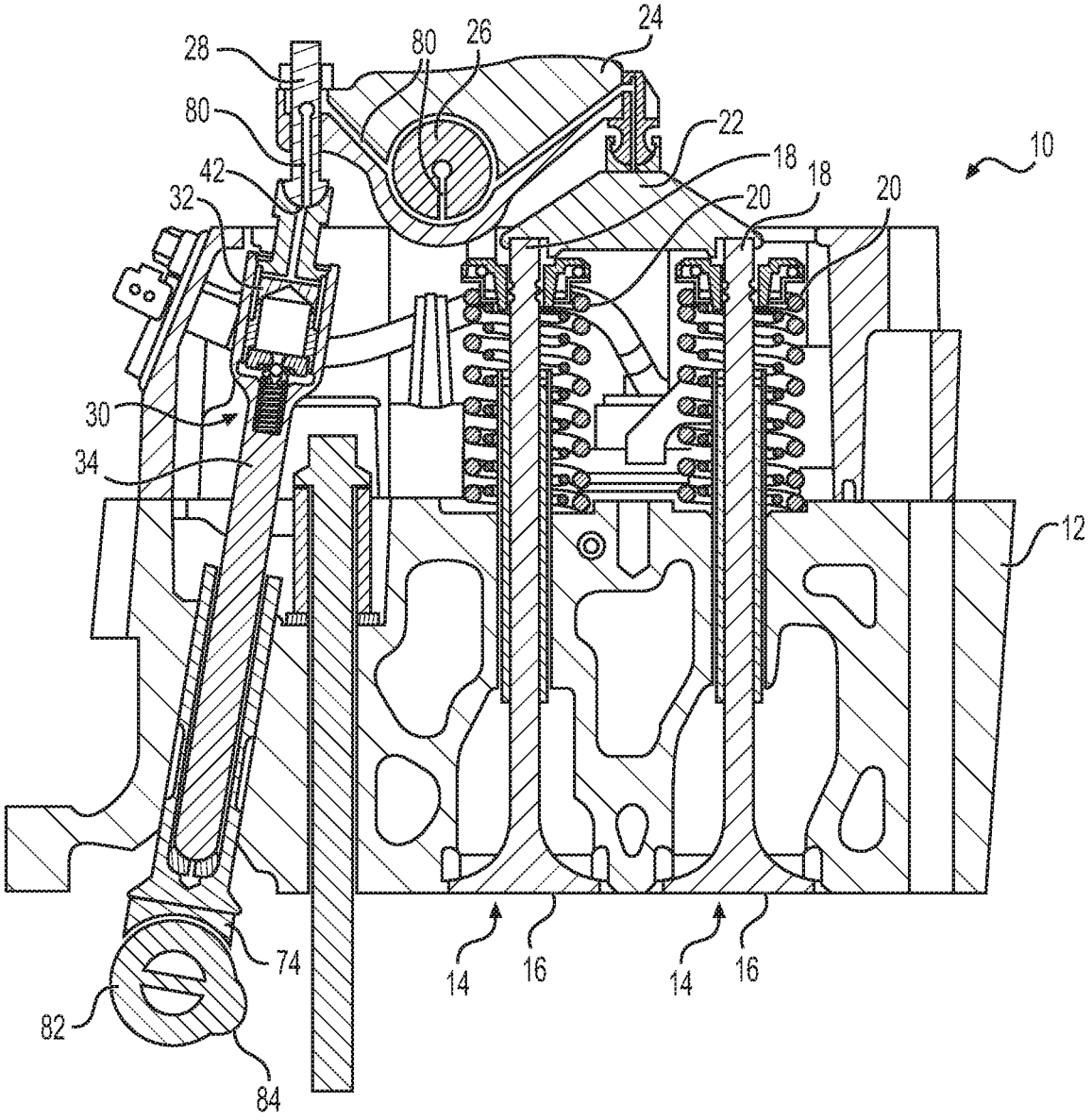
FIG. 1 is a sectional view of an internal combustion engine including an hydraulic lash adjuster according to aspects of the disclosure.

FIG. 1 illustrates a sectional view of an internal combustion engine 10 that includes a cylinder head 12 having one or more piston cylinders. Cylinder head 12 includes at least one intake valve 14 and a least one exhaust valve for each piston cylinder. Engine power is generated by a combustion reaction in which a piston is driven to reciprocate within each cylinder. Intake air enters each cylinder by one or more intake valves while combustion products are exhausted from each cylinder by one or more exhaust valves.

Two valves 14 are illustrated in FIG. 1, each valve 14 includes a valve head 16 and a valve stem 18. Each valve 14 is biased towards a closed position by a valve spring 20 disposed at an upper portion of each valve stem 18. A bridge 22 is disposed so as to connect the ends of valve stems 18 to a rocker 24. Rocker 24 includes a shaft 26 disposed at a central portion thereof. Rocker 24 is pivotable about an axis defined by shaft 26. An end of rocker 24 opposite to bridge 22 contains a threaded through-hole in which an adjusting screw 28 is disposed. Adjusting screw 28 extends from rocker 24 into contact with a hydraulic lash adjuster (HLA) 30. HLA 30 may extend between adjusting screw 28 and a lifter 74 and camshaft 82 assembly. HLA may and include a piston 32 and a pushrod 34, with the piston 32 being received within a distal cavity 36 of a pushrod 34.

A hydraulic fluid circuit of the HLA includes a path 80 that provides hydraulic fluid to HLA 30. In one aspect, the hydraulic fluid flowing through path 80 may be oil. Path 80 may begin in shaft 26 of rocker 24 and form a passage in rocker 24 that connects to a corresponding passage in the interior of adjusting screw 28. Path 80 may supply hydraulic fluid through adjusting screw 28 to the piston 32.

Figure 2:
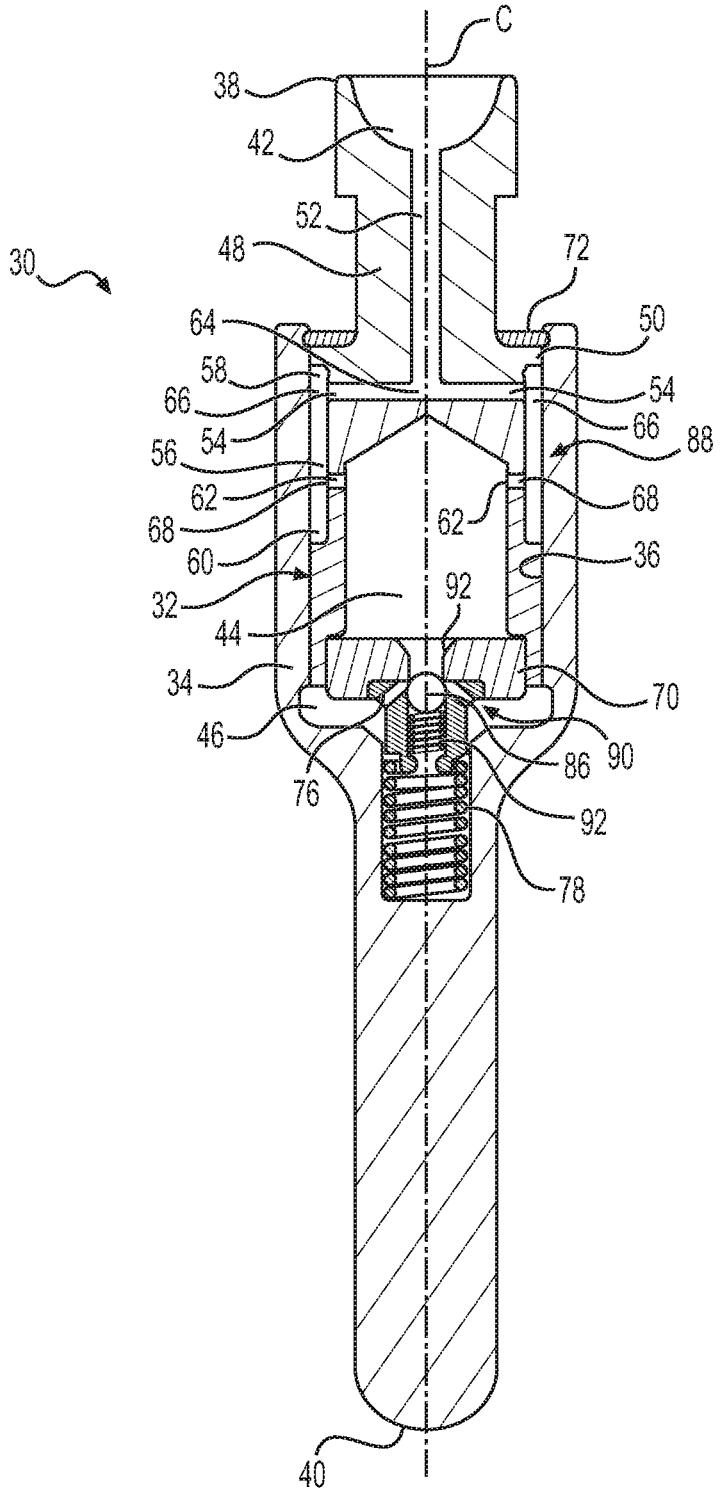
FIG. 2 is a sectional view of the hydraulic lash adjuster of FIG. 1.

FIG. 2 illustrates a sectional view of HLA 30. As noted above, HLA 30 may include piston 32 movable within a distal opening in pushrod 34. Thus, piston 32 may form a first, distal end 38 of HLA 30, and a proximal end of pushrod 34 may form a second, proximal end 40 of HLA 30 at a position opposite to first end 38 in a longitudinal direction. In one aspect, a central axis C may form a longitudinal axis of HLA 30 that extends from first end 38 to second end 40. As can be seen in FIG. 2, piston 32 and pushrod 34 may each extend in a longitudinal direction defined by central axis C.

Piston 32 may include, from distal to proximal, a recess 42 for receiving an end of adjusting screw 28 and providing a fluid communication with hydraulic fluid path 80, a widened distal portion from which a neck 48 extends, a central body 88 extending proximally from neck 48, and proximal end 70 including a check valve 90. Central body 88 of piston 32 may include a circumferential recess 56 and an internal reservoir 44. A fluid pathway may extend to internal reservoir 44. This fluid pathway may include a longitudinal passage 52 and a radial passage 54. Longitudinal passage 52 may extend from recess 42 through neck 48 and to one or more radial passages 54, thereby connecting path 80 to the circumferential recess 56 of piston 32. Circumferential recess 56 may also form part of the fluid pathway, and connects to the internal reservoir 44 via a plurality of radial reservoir passages 62. Thus, longitudinal passage 52, radial passage 54, recess 56, and reservoir passages 62 may form a fluid pathway to reservoir 44. As shown in FIG. 2, radial passages 54 may be directly connected to longitudinal passage 54 and extend from an end of longitudinal passage 54 to connect to circumferential recess 56 at a location distal of the reservoir passages 62. Thus, circumferential recess 56 may be in fluid communication with longitudinal passage 52 by radial passages 54. Proximal end 70 of piston 32 may include a longitudinal passage 76 selectively communicating internal reservoir 44 with cavity 36 of pushrod 34 via check valve 90.

With continued reference to FIG. 2, longitudinal passage 52 may extend longitudinally from recess 42 at distal end 38 so as to be approximately aligned with (as shown) or parallel to central axis C. Longitudinal passage 52 may be a narrow passage that has a smaller diameter than recess 42. In one aspect, longitudinal passage 52 may be an approximately cylindrical passage having a diameter of approximately 1.6 mm. Longitudinal passage 52 may terminate at an intersection with the one or more radial passages 54, that extend substantially radially within piston 32 in a direction toward diametrically opposite sides of piston 32 within cavity 36. HLA 30 may include two radial passages 54, circumferentially separated by 180 degrees 3, or may include three, four, or more radial passages 54. As illustrated in FIG. 2, radial passage 54 may extend normal to longitudinal passage 52 so that the intersection of longitudinal passage 52 and radial passage 54 forms a first turn 64. In one aspect, as shown, turn 64 may be a turn of approximately 90 degrees. However, first turn 64 may be a somewhat more gradual turn (extending slightly downward) or a somewhat sharper turn (extending slightly upward).

As shown in FIG. 2, the one or more radial passages 54 may extend through an axial center of piston 32 represented by central axis C. Like longitudinal passage 52, the one or more radial passages 54 may be a narrow passage having an approximately cylindrical shape. In one aspect, the one or more radial passages 54 may have a diameter of approximately 1.6 mm. Thus, longitudinal passage 52 and radial passage 54 may have approximately equal diameters. As noted above, radial passages 54 may terminate at the circumferential recess 56. Thus, recess 56 may extend from the end of one or more radial passages 54 in an outer surface of central body 88. Thus, longitudinal passage 52 and the one or more radial passages 54 may provide a continuous passage that connects distal recess 42 and circumferential recess 56 with a generally constant diameter pathway.

The one or more radial passages 54 and circumferential recess 56 of piston 32 may intersect at one or more locations within HLA 30 to form a plurality of second turns 66. Like the first turn 64, the second turns 66 may form a sharp turn of, for example, approximately 90 degrees. However, second turns 66 may be either a somewhat more gradual term or a somewhat sharper turn. Each radial passage 54 may open into recess 56 at a second turn 66. Thus, longitudinal passage 52 and radial passage 54 may form at least two turns (e.g., first turn 64 and second turn 66) in a fluid pathway between distal end 38 and reservoir 44.

Circumferential recess 56 may form a circumferential (360 degree) space between pushrod 34 and piston 32. In one aspect, recess 56 may be a circumferentially extending recess formed about the annulus, or outer peripheral surface, of piston 32. However, recess 56 may alternatively be formed as a circumferentially extending recess within the inner peripheral surface of cavity 36 of pushrod 34. Recess 56 may extend farther proximal than distal along a length of piston 32. Circumferential recess 56 may also extend distally and proximally beyond the passages 54 and 62 communicating with the recess 56. In particular, recess 56 includes a first recess end 58 and a second, opposite recess end 60. First recess end 58 may be located distally with respect to radial passages 54, reservoir 44, and reservoir passages 62 (above in FIG. 2). First recess end 58 may terminate at a wall 50 that extends circumferentially between first recess end 58 and a piston retaining member or snap ring 72. The second recess end 60 may be located proximal of the one or more reservoir passages 62 (below in FIG. 2). Thus, second recess end 60 may allow recess 56 to extend closer to a proximal end of HLA 30 than reservoir passage 62.

Figure 3:
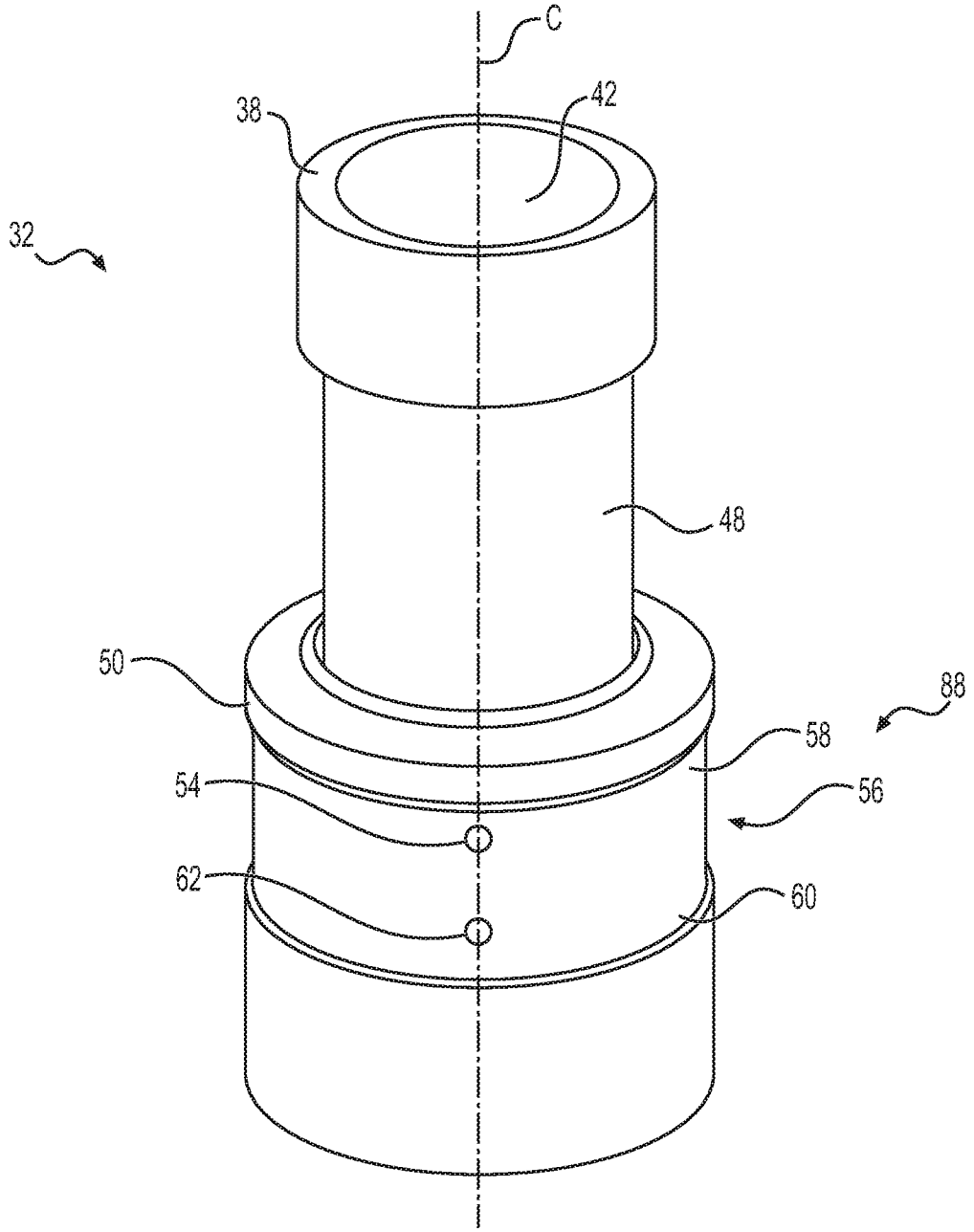
FIG. 3 is a perspective view of a piston of the hydraulic lash adjuster of FIG. 1.

As noted above, one or more reservoir passages 62 which may extend from circumferential recess 56 in a radially-inward direction toward reservoir 44, to fluidly connect recess 56 and reservoir 44. Each reservoir passage 62 may be a small hole or passage having a diameter of approximately 1.6 mm. Thus, reservoir passage 62 may have a diameter approximately equal to one or both of the diameters of the longitudinal passage 52 and the radial passages 54. Further, reservoir passage 62 may extend in a radial direction so as to form a third turn 68 of approximately 90 degrees with recess 56. In one aspect, two reservoir passages 62 may extend through piston 32 from recess 56 to reservoir 44, each of which forms a third turn 68. In another aspect, one, three, four or more than four reservoir passages 62 may be provided to connect recess 56 to reservoir 44. Regardless of the number of reservoir passages 62 provided, each may form a third turn 68 of approximately 90 degrees with recess 56. Thus, piston 32 may include a fluid pathway having at least three turns, including first turn 64, second turn 66, and third turn 68. Additionally, each of the reservoir passages 62 may be evenly spaced apart about a periphery of reservoir 44, and may be equal in number and circumferentially aligned with radial passages 54. However, reservoir passages 62 may also be unevenly distributed with respect to one another and/or radial passages 54, and HLA 30 may include more or less reservoir passages 62 than radial passages 54. Each reservoir passage 62 may extend entirely through an outer peripheral surface of piston 32 in which recess 56 is provided (FIG. 3).

With continued reference to FIG. 2, reservoir 44 may be formed inward of recess 56 within central body 88. A first end of reservoir 44 may be provided proximal with respect to longitudinal passage 52 and radial passage 54. An opposite second end of reservoir 44 may be formed by proximal end 70 of piston 32. Reservoir 44 includes a volume larger than circumferential recess 56.

Check valve 90 may be a one way valve that separates a pressure chamber 46 from the reservoir 44. In one aspect, check valve 90 is a ball valve having a valve passage 76 and a ball 86, which is biased by a biasing element (e.g., spring) 92 and longitudinal passage 76. Ball 86 is urged by biasing element 92 to selectively seal the reservoir 44 from the pressure chamber 46. Ball 86 may allow passage of hydraulic fluid from reservoir 44 to high pressure chamber 46 via longitudinal passage 76 by moving in a direction toward proximal end 40 and against a biasing force of biasing element 92. Ball 86 may block a flow of hydraulic fluid from high pressure chamber 46 to reservoir 44.

As mentioned above, HLA 30 may include a retaining member 72 secured within a groove of the cavity 36 of pushrod 34 to stop piston 32 from exiting cavity 36. In one aspect, retaining member 72 may be a retaining ring such as a snap ring. Thus, piston 32 is movable within cavity 36 between a bottom of cavity and retaining member 72, with the biasing element 78 urging piston 32 toward retaining member 72. It is understood that the clearance between the piston 32 and the sidewall of cavity 36 of pushrod 34 is small enough to restrict the free flow of hydraulic fluid, but still allows some quantity of hydraulic fluid to lubricate the outer diameter of piston 32 and the sidewalls of cavity 36 pushrod 34. Thus, significant friction between piston 32 and the sidewall of cavity 36 may be avoided. It is also recognized that the clearance between piston 32 and the sidewall of cavity 36 may allow for the migration of air from circumferential recess 56 past wall 50 to exit HLA 30.

FIG. 3 illustrates a perspective view of piston 32 isolated from pushrod 34. As shown, the proximal (lower) portion of piston 32 includes the circumferential recess 56. Thus, circumferential recess 56 extends farther distal than proximal along a length of piston 32. As discussed above, recess 56 includes a distal end 58 and a proximal end 60, and aligned radial passages 54 and reservoir passages 62 (only set shown in FIG. 3).

As noted above, circumferential recess 56 may extend along an entire circumference of the outer surface of piston 32 (see FIG. 3). However, recess 56 may instead be formed along only a portion of the outer circumferential surface of piston 32. When formed along only a portion of the outer surface of piston 32, a plurality of separate recesses 56 may be provided at different circumferential locations about the outer surface of piston 32. First recess end 58 and second recess end 60 may similarly extend partially or entirely along the circumference of piston 32.

INDUSTRIAL APPLICABILITY

The disclosed aspects of the HLA 30 may be employed in a variety of applications, such as in internal combustion engines. When provided in a valve train of internal combustion engine 10, HLA 30 may assist in limiting lash in valve train components. Furthermore, HLA 30 may assist in removing air from the hydraulic fluid supplied to the HLA 30.

Returning to FIG. 1, during operation of the internal combustion engine 10, camshaft 82 is brought into rotational motion. As camshaft 82 rotates, lobe 84 regularly presses on lifter 74, which in turn translationally displaces HLA 30 toward adjustment screw 28 and one end of rocker 24.

Also during operation of the internal combustion engine 10, a lubrication pump may provide a flow of hydraulic fluid provide fluid to HLA 30. With reference to FIG. 1, the hydraulic fluid from such a lubrication pump may be supplied to shaft 26 of rocker 24, which may form a beginning of path 80 of hydraulic fluid. Hydraulic fluid may travel along the circumference of shaft 26 to an end of rocker 24 opposite bridge 22. Hydraulic fluid can then flow to an internal passage of adjusting screw 28.

An end of adjusting screw 28 is received by recess 42 of HLA 30. Hydraulic fluid may exit an opening provided at an end of adjusting screw 28 to enter recess 42, and in particular longitudinal passage 52. Thus, HLA 30 may be provided with a supply of hydraulic fluid via path 80 during the operation of internal combustion engine 10.

Hydraulic fluid may be stored within pressure chamber 46 of HLA 30. As shown in FIG. 2, hydraulic fluid in reservoir 44 is separated from pressure chamber 46 by one way valve 90. One way valve 90 may allow a relatively small quantity of hydraulic fluid to enter pressure chamber 46 from reservoir 44. Also, one way valve 90 may prevent hydraulic fluid from passing from the pressure chamber 46 to reservoir 44. Thus, pressure can be maintained within pressure chamber 46.

The flow of hydraulic fluid from path 80 to recess 42, may be guided by longitudinal passage 52 to subsequently take first turn 64 at the bottom of longitudinal passage 52 to transition the flow from longitudinal passage 52 to the one or more radial passages 54. As noted above, the first turn 64 may be a sharp turn of, for example, approximately 90 degrees. After entering turn 64, the flow of hydraulic fluid flow may proceed in a radially outward direction within the one or more radial passages 54. Once the flow of hydraulic fluid guided by radial passage 54 reaches an end of radial passage 54, the flow of hydraulic fluid is drawn into circumferential recess 56 of piston 32 via second turn 66. Second turn 66, like first turn 64, may be a sharp turn and may prevent air from entering recess 56. Additionally, second turn 66 may allow air contained within the hydraulic fluid to be directed upward in a direction distally toward first end 38 of piston 32.

Hydraulic fluid may flow to reservoir 44 via reservoir passages 62 and third turn 68. When recess 56 and reservoir 44 are both filled with hydraulic fluid, air in the hydraulic fluid may migrate to first recess end 58 that extends distal of the one or more radial passages 54. Air may then exit HLA 30 by passing between wall 50 and the sidewall of cavity 36 of pushrod 34. Furthermore, second recess end 60 provides a further location for collecting air in the hydraulic fluid, thus assisting in preventing air from passing to reservoir 44. Air captured by second recess end 60 may then migrate distally along circumferential recess 56 and to first recess end 58.

Thus, the various shapes and sizes of passages and recesses of HLA 30 may assist in collecting and allowing air entrained in the hydraulic fluid to escape. For example the longitudinal extent of circumferential recess 56, the extension of circumferential recess 56 above radial passages 54, the relatively small size of wall 50, and the numerous turns of the flow of hydraulic fluid may individually and collectively help to collect and remove air from the HLA 30. With such an arrangement, air or bubbles contained in hydraulic fluid supplied to HLA 30 may be continuously collected and allowed to migrate out of the HLA 30. Such a removal of air from the HLA 30 may facilitate a more robust HLA that is less susceptible to inaccuracies caused by a build-up of air in the HLA 30.

It will be apparent to those skilled in the art that various modifications and variations can be made to the disclosed HLA 30 without departing from the scope of the disclosure. Other embodiments of the piston 32 and HLA 30 will be apparent to those skilled in the art from consideration of the specification and practice of the system disclosed herein. It is intended that the specification and examples be considered as exemplary only, with a true scope of the disclosure being indicated by the following claims and their equivalents.

What is claimed is:

1. A hydraulic lash adjuster, comprising:

a longitudinally extending pushrod having a proximal end, a distal end, and a cavity extending through the distal end; and a piston received in the cavity, the piston including:

an internal reservoir; and a fluid pathway to the internal reservoir, the fluid pathway including:

a longitudinal passage;

a radial passage;

a reservoir passage extending to the internal reservoir; and a recess fluidly connected between the radial passage and the reservoir passage; and a one-way valve that is downstream of the internal reservoir, the longitudinal passage, the radial passage, and the recess during operation of an internal combustion engine in which the hydraulic lash adjuster is installed.

2. The hydraulic lash adjuster of claim 1, wherein the radial passage directly connects to the longitudinal passage and extends normal to the longitudinal passage.

3. The hydraulic lash adjuster of claim 2, wherein the longitudinal passage extends to a distal end of the piston.

4. The hydraulic lash adjuster of claim 3, wherein the longitudinal passage extends along a central axis of the piston.

5. The hydraulic lash adjuster of claim 4, wherein the radial passage extends to an outer surface of the piston.

6. The hydraulic lash adjuster of claim 5, wherein the radial passage extends across the piston to diametrically opposite sides of the piston.

7. The hydraulic lash adjuster of claim 1, wherein the recess is a circumferential recess formed in an outer surface of the piston.

8. The hydraulic lash adjuster of claim 7, wherein the radial passage extends to the circumferential recess and the reservoir passage extends to the circumferential recess from the internal reservoir.

9. The hydraulic lash adjuster of claim 8, wherein the circumferential recess extends distally beyond the radial passage and proximally beyond the reservoir passage.

10. The hydraulic lash adjuster of claim 1, wherein the fluid pathway includes at least three turns.

11. The hydraulic lash adjuster of claim 10, wherein each of the at least three turns are approximately 90 degrees.

12. The hydraulic lash adjuster of claim 1, wherein the longitudinal passage is upstream of the internal reservoir, the radial passage is upstream of the internal reservoir, and the recess overlaps the internal reservoir in a radial direction.

13. The hydraulic lash adjuster of claim 1, wherein the longitudinal passage extends, within a neck of the piston, distally beyond the pushrod.

14. A hydraulic lash adjuster, comprising:

a longitudinally extending pushrod having a proximal end, a distal end, and a cavity extending through the distal end; and a piston received in the cavity, the piston including:

an internal reservoir, and a fluid pathway to the internal reservoir, the fluid pathway including:

a longitudinal passage, a radial passage, a circumferential recess formed in an outer surface of the piston; and a reservoir passage extending radially to the internal reservoir; and a one-way valve that is downstream of the internal reservoir and the fluid pathway during operation of an internal combustion engine in which the hydraulic lash adjuster is installed.

15. The hydraulic lash adjuster of claim 14, wherein the circumferential recess extends distally of the radial passage.

16. The hydraulic lash adjuster of claim 14, wherein the circumferential recess forms a turn of approximately 90 degrees with the radial passage.

17. The hydraulic lash adjuster of claim 14, wherein the circumferential recess extends around an entire circumferential surface of the piston.

18. The hydraulic lash adjuster of claim 14, wherein the circumferential recess extends proximally of the reservoir passage.

19. The hydraulic lash adjuster of claim 14, wherein the longitudinal passage is upstream of the internal reservoir, the radial passage is upstream of the internal reservoir, and the circumferential recess overlaps the internal reservoir in a radial direction.

20. The hydraulic lash adjuster of claim 14, wherein the longitudinal passage extends, within a neck of the piston, distally beyond the pushrod.

* * * * *